US005879231A

United States Patent [19]

Sisk

[11] Patent Number: 5,879,231

[45] Date of Patent: Mar. 9, 1999

[54] MINE VENTILATION STRUCTURE

[76] Inventor: Frank A. Sisk, 285 Ridgeway Rd., Eldorado, Ill. 62930

[21] Appl. No.: 976,025

[22] Filed: Nov. 21, 1997

[51] Int. Cl.[6] ..... E21F 1/14

[52] U.S. Cl. ..... 454/169; 405/132; 405/153

[58] Field of Search ..... 454/168, 169; 52/309.12, 405.3; 405/132, 151, 153, 288, 290

[56] References Cited

U.S. PATENT DOCUMENTS

| | | | |
|---|---|---|---|
| 4,096,702 | 6/1978 | Burton . | |
| 4,104,842 | 8/1978 | Rockstead et al. | 52/309.12 X |
| 4,393,636 | 7/1983 | Rockstead et al. . | |
| 4,418,463 | 12/1983 | McNeill . | |
| 4,516,879 | 5/1985 | Berry et al. | 405/132 |
| 4,621,951 | 11/1986 | Dewson | 405/303 |
| 5,174,682 | 12/1992 | Whitfield | 405/132 |
| 5,466,187 | 11/1995 | Kennedy et al. | 454/169 |

*Primary Examiner*—Harold Joyce
*Attorney, Agent, or Firm*—Grace J. Fishel

[57] ABSTRACT

A mine ventilation structure used to block a passageway or to prevent mixture of ventilation air at the intersection of two passageways. The passageway has sidewalls and a ceiling. The ventilation structure is formed of panels, each of the panels having spaced apart wire grids with an insulation core. The grids are interconnected with strut wires passing through the insulation core and forming a truss system. A layer of concrete is applied as gunite or shotcrete to the panels embedding the strut wires and covering the wire grids. The layer of concrete extends beyond the margins of the ventilation structure onto the sidewalls and ceiling of the passageway forming a monolithic structure sealed in the passageway that is virtually impervious to air.

12 Claims, 5 Drawing Sheets

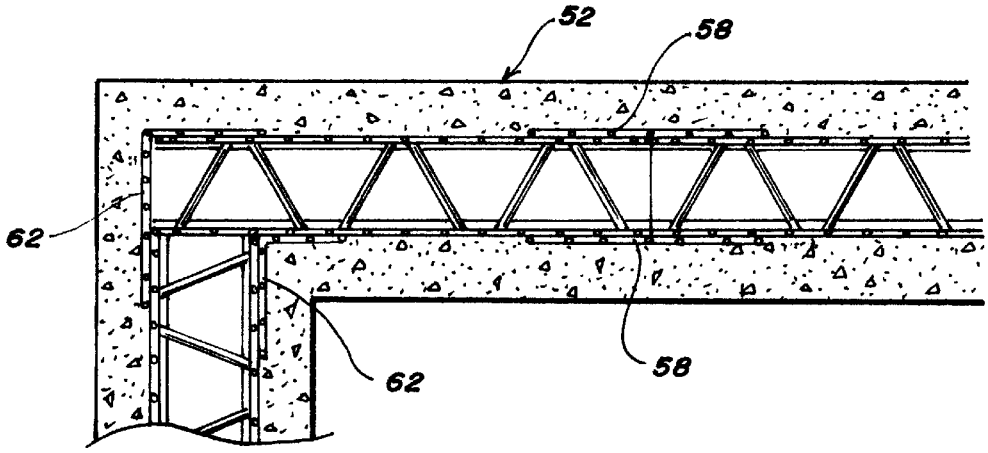
FIG. 5
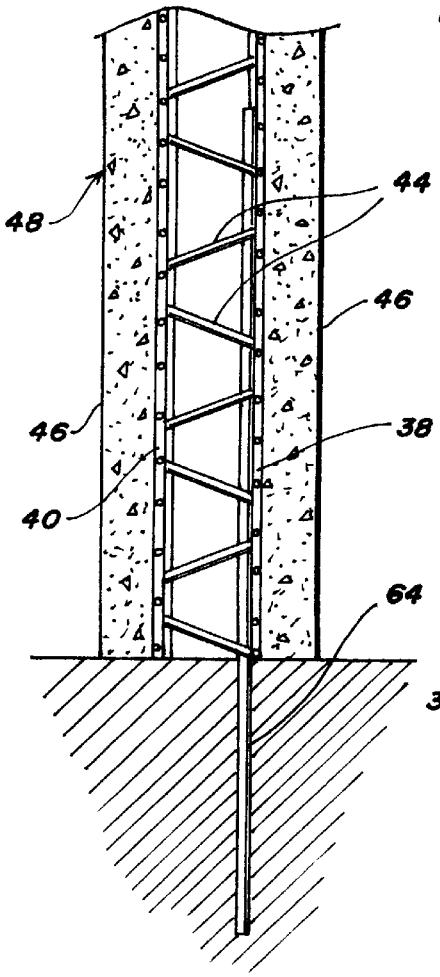
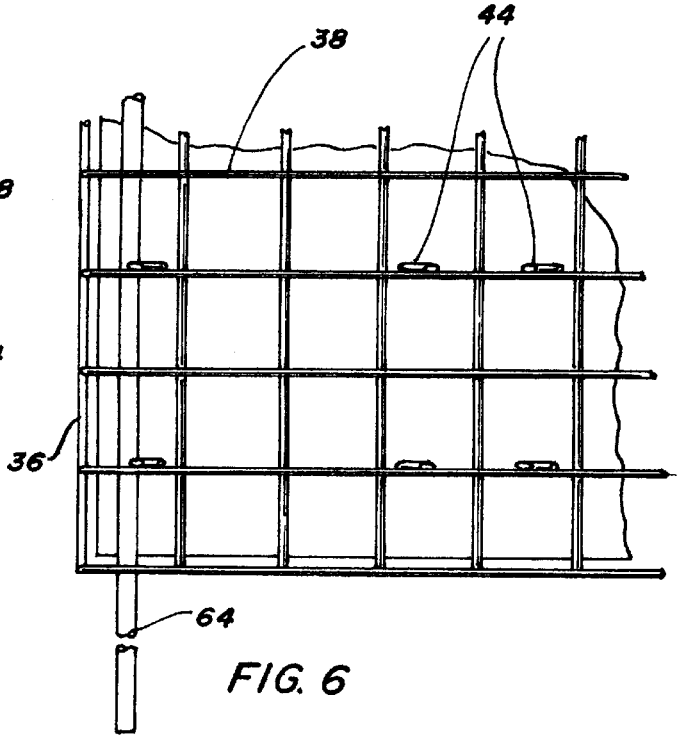
FIG. 6
FIG. 7
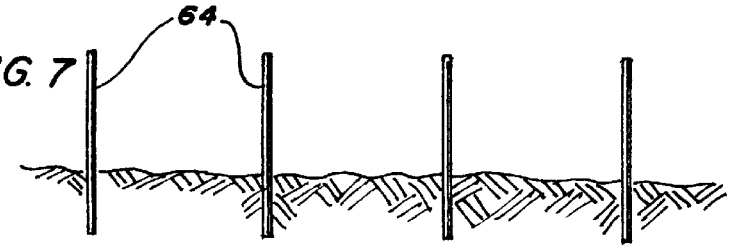

MINE VENTILATION STRUCTURE

BACKGROUND OF THE INVENTION

1. Field of the Invention

The present invention relates to a mine ventilation structure used to block a passageway or to prevent mixture of ventilation air at the intersection of two passageways. The ventilation structure blocking a passageway can be a shaft partition, stopping or regulator. The ventilation structure preventing the mixture of ventilation air at the intersection of two passageways can be an overcast or an undercast.

2. Brief Description of the Prior Art

In an underground mine having a grid of intersecting passageways separated by columns of remaining material, there is a need for a ventilation system as the mining activity becomes more distant from a source of ventilation. In a typical ventilation system, intake air and return air are ducted through air shafts formed by selected passageways. Along the air shafts, intersecting passageways are blocked with a partition or ducted through an overcast or an undercast.

The return air in a coal mine contains coal dust and methane so it is important that there be no intermingling of the return air with the intake air. Permanent barriers, such as those constructed of concrete block, steel plates or the like, have been used to define the passageways forming the air shafts. Even though the prior art structures are treated with sealants, a significant amount of air leaks through these structures, heard in the mine as a sucking sound. At overcasts and undercasts, the leaks result in intermingling of the return and intake air and at the barriers result in a significant loss of pressure when repeated at multiple barriers along shafts that may extend for thousands of feet.

In addition to leaking air, prior art partitions, overcasts and undercasts made of concrete blocks, steel plates and the like require large amounts of materials that are heavy and difficult to handle in the confined space within a mine. For example, an overcast made with sidewalls of concrete block takes about eight pallets of block, loaded two pallets to a trailer, plus five pallets of mortar. If the deck is suspended on iron beams, the beams weigh about 600 pounds and are lifted into place by hand because of space limitations. Concrete planks are laid over the beams, requiring several more pallets of materials. Bucket-type mine sealant is applied to the deck to seal the gaps between the planks and to seal the ends of the sidewalls to the coal columns between which they are installed. It takes a crew of six men about three shifts to construct an overcast, the work is dangerous and injuries are common. The space between the planks and the gap between the ends of the walls and the coal columns open up in time. Similar construction and leakage problems are encountered with overcasts made of steel plates that are bolted together.

BRIEF SUMMARY OF THE INVENTION

In view of the above, it is an object of the present invention to provide a mine ventilation structure that does not require continual maintenance to provide a good air seal. It is another object to provide a ventilation structure that is made of relatively light-weight component parts which can be easily transported into the mine and quickly assembled. It is also an object to provide a ventilation structure which is economical to make and fire resistant. Other objects and features of the invention will be in part apparent and in part pointed out hereinafter.

A mine ventilation structure is provided in accordance with the present invention for use in an underground mine having a grid of intersecting passageways separated by columns of remaining material. When the ventilation structure is a barrier, stopping, regulator or the like, it is formed as a wall with a plurality of panels fitted up to the ceiling, spanning the passageway to be blocked. The panels are assembled in side-by-side relationship with wire fasteners, each panel having first and second spaced apart wire grids with an insulation core. The grids are interconnected with strut wires passing though the insulation core and forming a truss system. A layer of concrete is applied as gunite or shotcrete to the assembled panels embedding the strut wires and covering the wire grids. The layer of concrete is applied such that it extends beyond the margins of the wall along the passageway and the ceiling ensuring that the ventilation structure forms an air seal.

If the ventilation structure is an overcast or an undercast for installation at an intersection of first and second passageways in an underground mine, the ventilation structure defines a first airway communicating with the first passageway and a second airway communicating with the second passageway. The ventilation structure in this instance includes a pair of generally parallel, spaced-apart sidewalls forming the walls of the first airway. Each of the sidewalls being formed of a plurality of panels assembled in side-by-side relationship with wire fasteners as described above. A deck that serves as a roof to the first airway and a floor to the second airway is formed from a plurality of similar panels spanning the full distance between the sidewalls. If the sidewalls do not reach the ceiling of the first passageway at the intersection, a pair of wing walls are mounted on the deck between the sidewalls. The wing walls span the distance between the ceiling in the passageway and the deck.

When the infrastructure of the overcast or undercast is coated with a layer of concrete applied as gunite or shotcrete, a monolithic ventilation structure is formed which is virtually air impervious. A good air seal is also obtained between the ventilation structure and the pillars, requiring substantially no maintenance, when the pillars are sprayed with concrete applied as gunite or shotcrete several feet beyond the margins of the ventilation structure.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, two of various possible embodiments of the invention are illustrated, corresponding reference characters referring to corresponding parts throughout the several views of the drawings in which:

FIG. 5 is an end elevational view, in section, showing the panels forming the sidewalls and the deck of the overcast;

FIG. 6 is a side view of a corner of the panel in the sidewall shown in FIG. 5 attached to a reinforcing member;

FIG. 7 is a side elevation of the reinforcing members forming a footing for the sidewalls;

DETAILED DESCRIPTION OF THE INVENTION

Figure 2:
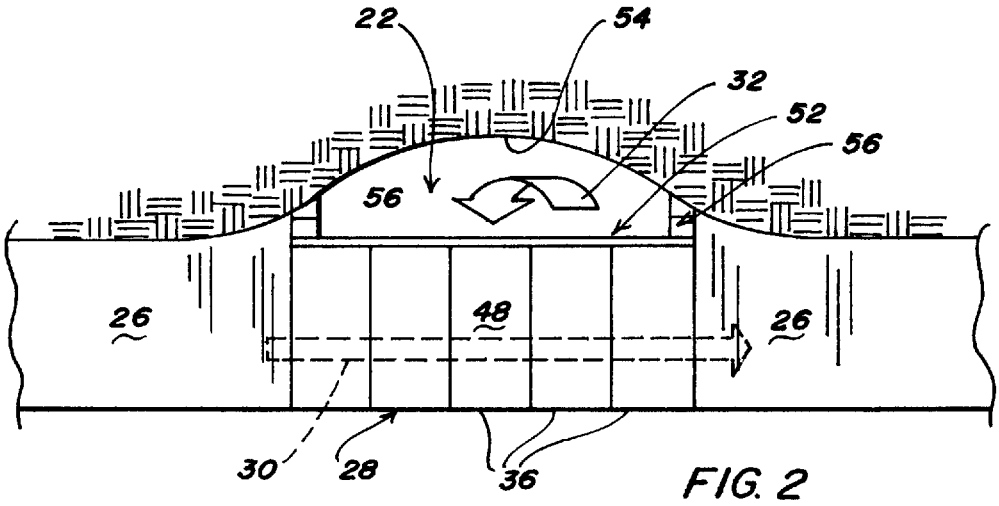
FIG. 2 is a side elevation showing the overcast in a typical installation, with an arrow in broken lines depicting air flow within the overcast in the intake passageway and an arrow in full lines showing airflow over the overcast in the return passageway.
Figure 3:
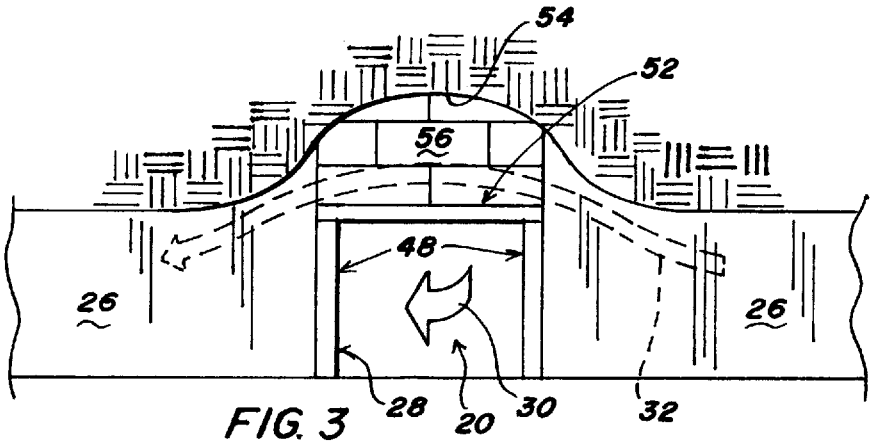
FIG. 3 is another view in elevation, looking from right to left in FIG. 2, again illustrating by arrows the air flow through the overcast.
Figure 4:
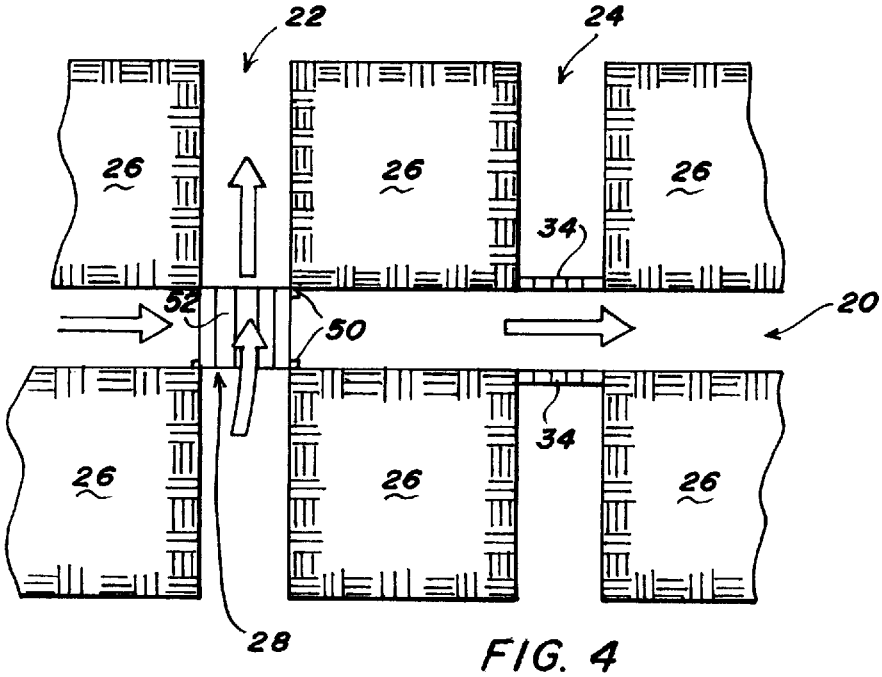
FIG. 4 is a top plan view of a typical passageway grid pattern in an underground mine where, again, arrows depict airflow, with the overcast installed at the intersection of two passageways and a pair of barriers installed at another intersection.

Referring now to the drawings, in particular to FIG. 4, there are shown first, second and third intersecting passageways 20, 22 and 24, respectively, between coal pillars 26. First passageway 20 is a intake shaft for fresh air and second passageway 22 is a return shaft for contaminated air from the working face of an underground mine having a grid of intersecting passageways separated by columns of remaining material. As shown in FIGS. 2 and 3, taken in combination with FIG. 4, an overcast 28 in accordance with the present invention provides a first airway 30 communicating with first passageway 20 for ducting the intake air under overcast 28 and a second airway 32 communicating with second passageway 22 for ducting the return air over the overcast. A barrier 34 in accordance with the present invention is provided in third passageway 24, one on each side of first passageway 20, to block air flow between the first and third passageways. It is to be understood that while the preferred embodiments of the ventilation structures in accordance with the present invention are overcasts 28 and barriers 34, the ventilation structure may be an undercast (i.e., of the type which allows air in second passageway 22 to flow through the intersection under the floor of first passageway 20), a stopping or a regulator.

Figure 10:
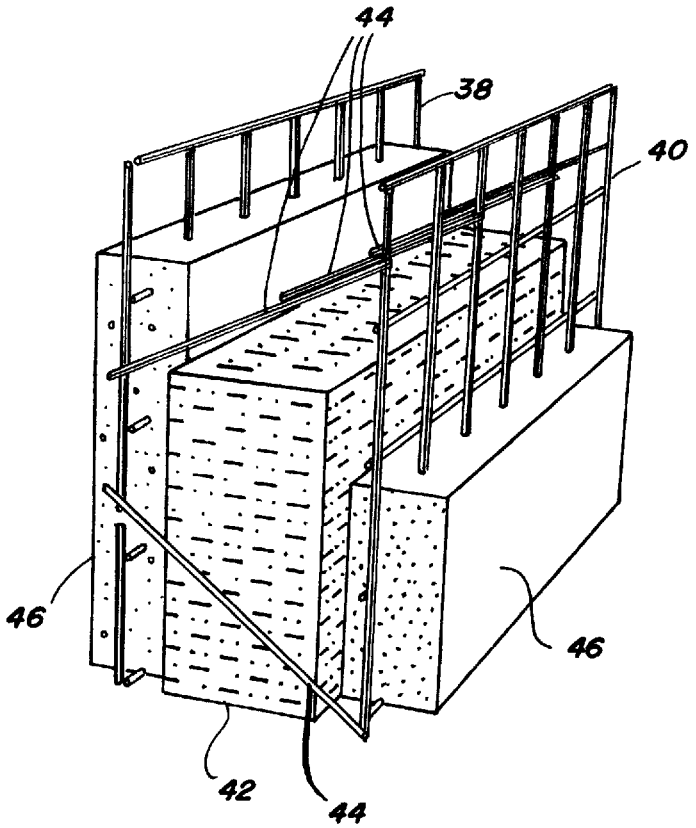
FIG. 10 is a perspective view of the panels formed by spaced sheets of wire mesh interconnected with wire trusses and having an insulation core, said wire mesh and wire truses embedded in layers of concrete applied as gunite or shotcrete; and, FIG. 11 is a view in cross-section showing an end of the sidewalls curled around a pillar and being sealed to the pillar with a layer of concrete applied as gunite or shotcrete.

The ventilation structures (overcast 28 and barrier 34) are formed of prefabricated panels 36, details of which are shown in FIG. 10. Each of panels 36 has first and second spaced apart wire grids 38, 40, respectively, with an insulation core 42. Grids 38, 40 are interconnected with strut wires 44 passing though insulation core 42 and forming a truss system. Suitable panels are sold by Insteel Construction Systems, Inc. as a 3-D Building Panel System. The Insteel panels are 4 feet wide and sold in lengths from 8 to 25 feet. Insulation core 42 is formed of polystyrene, although other foamed polymers such as polyurethane and the like may be used. Good results have been obtained when insulation core 42 is 2½ inch thick and a polystyrene foam with a minimum density of 0.9 pounds per cubic foot as this material has excellent flame spread and smoke ratings.

Each of grids 38, 40 has a 2-inch welded mesh pattern of longitudinal and transverse wires of the same diameter, 11 gauge being preferred. Strut wires 44 are preferably formed of 9 gauge wire and welded continuously in the required spacing so they form, with grids 38, 40, a triangulated truss system which greatly increases the panel strength. The insulation core 42 is held about ¾ inch from each of grids 38, 40 to permit the wire to be embedded in a layer of concrete 46 applied as gunite or shotcrete approximately 1½ inch thick. This layer of concrete 46 is applied to the panels after the ventilation infrastructure, as more particularly described, is constructed. Panels having layer of concrete 46 may be designed to have a three-hour fire resistance.

Figure 1:
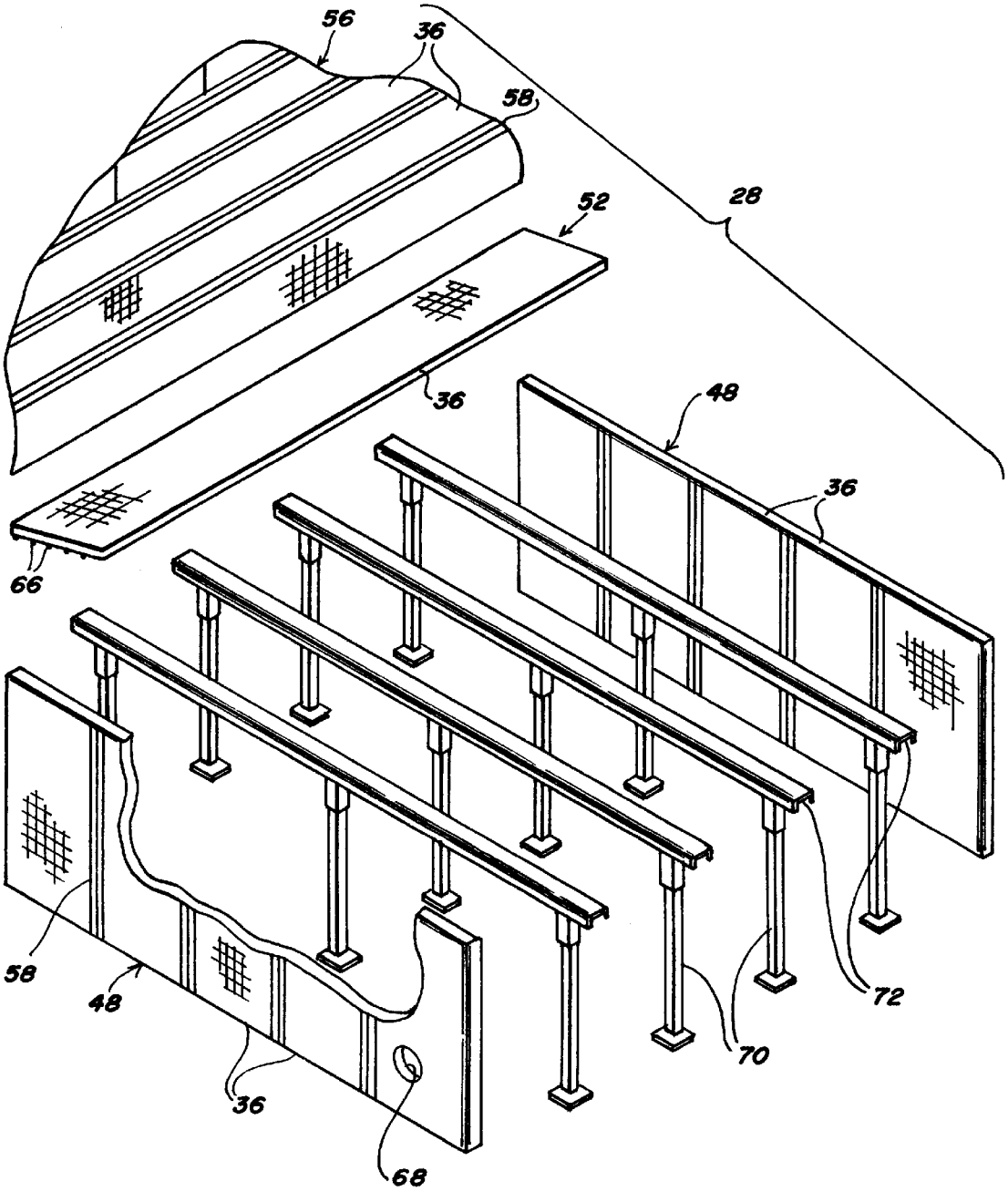
FIG. 1 is an exploded perspective view of an infrastructure of an overcast in accordance with the present invention, supported with a plurality of jacks ready to be coated with a layer of concrete applied as gunite or shotcrete.

Turning now to FIG. 1, overcast 28 in major part has a pair of generally parallel, spaced-apart sidewalls 48 forming the sidewalls of first airway 30. Each of sidewalls 48 is formed of a plurality of panels 36, spanning the distance between pillars 26 bounding second passageway 22, said sidewalls preferably extending past the intersection of the passageways a short distance along the pillars 26 forming an overhang 50 (shown in FIGS. 4 and 11) for use as described below. Panels 36 are assembled vertically in side-by-side relationship with wire fasteners.

A deck 52 extends between sidewalls 48 and forms the roof of first airway 30 and the floor of second airway 32. Deck 52 is formed of a plurality of panels 36 (only one of which is shown in FIG. 1 for purposes of clarity) spanning the full distance between the sidewalls. Panels 36 in deck 52, like those in sidewalls 48, are assembled in side-by-side relationship, with adjacent panels clamped together with wire fasteners.

As shown in FIGS. 2 and 3, the height of ceiling 54 in second passageway 22 at the intersection must be increased to make way for second airway 32. When the height of the ceiling in the first passageway 20 is also increased so that spaced-apart sidewalls 48 do not reach ceiling 54 at the intersection of the two passageways, the overcast also includes a pair of wing walls 56. Each of wing walls 56 is formed of panels 36 spanning the full distance between deck 52 and ceiling 54. These panels are assembled, preferably horizontally, in side-by-side relationship with adjacent panels clamped together with wire fasteners. Wing walls 56 are positioned on deck 52 above sidewalls 48. Portions of panels 36 nearest the ceiling may be contoured, as best seen in FIG. 1, by snipping the mesh wires forming grids 38, 40 with a pair of bolt cutters, followed with a hand saw to cut out insulation core 42.

Figure 9:
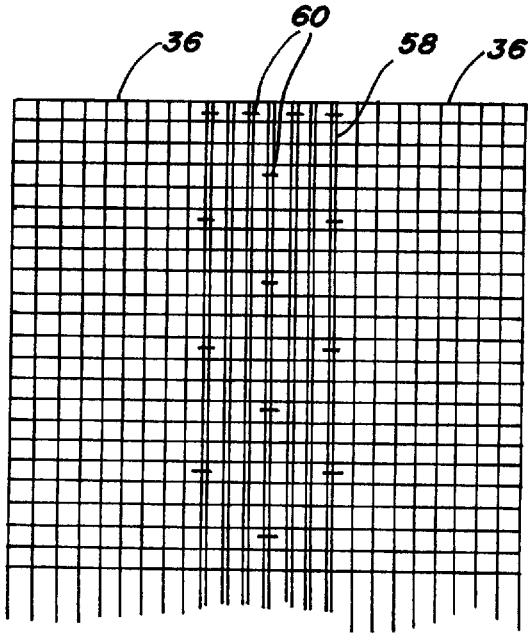
FIG. 9 is a side elevation of two panels in side-by-side relationship joined with a strip of cover mesh.

Strips 58 of cover mesh, best seen in FIG. 9, are used to reinforce both sides of each panel seam in sidewalls 48, deck 52 and wing walls 56. Strips 58 should have the same welded mesh pattern and be formed of wire having the same gauge as grids 38, 40. Strips 58 are preferably set with equal spacing on either side of each panel juncture and, when panels 36 are four feet wide, are preferably 12 inches wide. Strips 58 are attached to grids 38, 40 with a plurality of connectors 60 as shown in FIG. 9, more being provided at the ends of each panel. Other strips 62 of cover mesh preformed with 90 degree bends, shown in FIG. 5, are used on the inside and outside corners to secure adjoining sections of the sidewalls, deck and wing wall.

Reinforcing members 64, as shown in FIGS. 5–7, are placed in sidewalls 48 to secure the base of panels 36. Lengths of straight rebar extending vertically out of the mine floor can be used for this purpose. The height of the rebar is preferably about 24 inches with 12 inches buried in the floor. Reinforcing members 64 must be set very accurately in a direction perpendicular to the panel face, as they should project to the inside of grids 38, 40 (e.g., the grid on the side of the panel facing first airway 30) and still be covered with enough of concrete 46 to develop the full tensile strength of the bar in the panel. In general, bars no larger than #4 should be used, and #3 are preferred, because of the cover requirements. When there are wing walls, other metal reinforcing members (not shown) may be installed in ceiling 54 for stabilizing wing walls 56.

Figure 8:
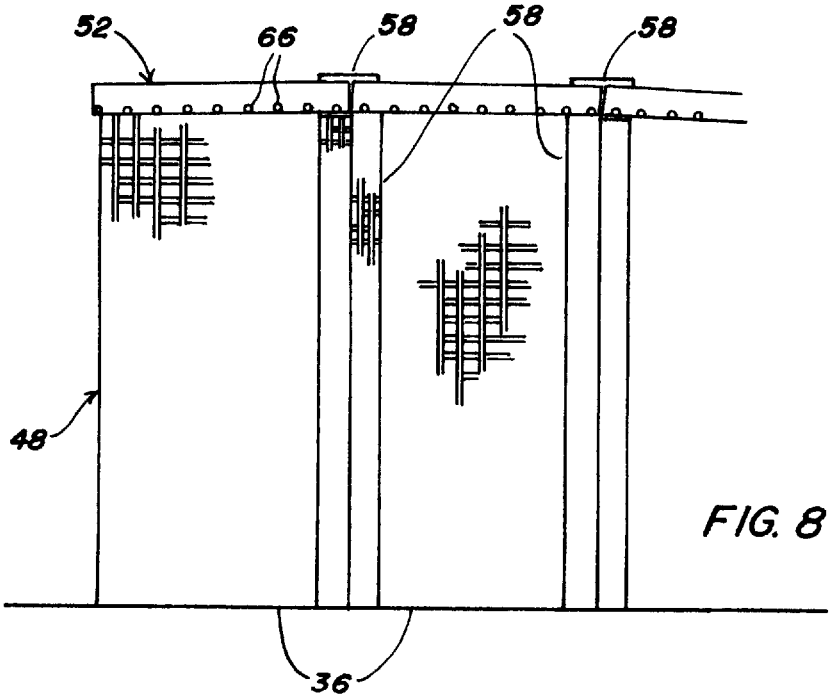
FIG. 8 is a rear elevation of the sidewalls, a portion of which is deleted for purpose of clarity, as viewed from the second passageway and showing the rebar reinforcement in the deck panels.

As shown in FIGS. 1 and 8, panels 36 in deck 52 should be reinforced with lengths of rebar 66, running parallel with the long axis of the panels. Rebar 66 in deck 52, like reinforcing members 64 for supporting sidewalls 48 or wing walls 56, should project to the inside of grids 38, 40 (e.g., the grid on the lower side of deck 52). Rebar 66 in deck 52 is preferably as large as possible, consistent with being covered with enough of concrete 46 to develop good tensile strength. When panels 36 are as described above, rebar 66 is preferably spaced at six inch intervals.

Rebar reinforced deck 52 is capable of supporting its own weight, as well as the load caused by persons traveling across the deck, debris falling down onto the ventilation structure and machinery passing over the deck without the need for wire supports from the ceiling. This is an advantage as the installation of wire supports takes time and the wires obstruct the path of travel through second airway 32.

The overcast structure of the present invention can be erected quickly by only a few laborers. It takes three shifts only because it takes time for the concrete to set. By way of example, the structure may be erected positioning panels 36 forming sidewalls 48 vertically over reinforcing members 64 which are installed in the mine floor. Sidewalls 48 are preferably installed such that they span the distance between pillars 26 bounding second passageway 22 and form overhang 50. Strips 58 of cover mesh are installed at the junction between adjacent panels.

Rebar 66 is installed at spaced intervals in panels 36 forming deck 52 and secured to the adjacent wire grid with suitable fasteners such as a wire tie. Panels 36 forming deck 52 span the full distance between the sidewalls and are placed on the top edge of sidewalls 48. Strips 58 of cover mesh are installed at the junction between adjacent panels and other strips 62 of cover mesh preformed with 90 degree bends are used on the inside and outside corners to secure adjoining sections of deck 52 and sidewalls 48.

When wing walls 56 are needed, panels 36 are positioned horizontally on deck 52, building the wall upward until it spans the full distance between deck 52 and ceiling 54. If reinforcing members 64 are provided in ceiling 54, they are slipped between one of grids 38, 40 and insulation core 42, otherwise (or additionally), wing wall may be stabilized with external braces during construction. Strips 58 of cover mesh bridge the connections between adjacent panels and other strips 62 are used on the inside and outside joints between deck 52 and wing walls 56. A port 68 may be installed in sidewalls 48 to give access through overcast 28 to second passageway for rock dusting. A prehung door (not shown) may also be installed, if desired.

Figure 11:
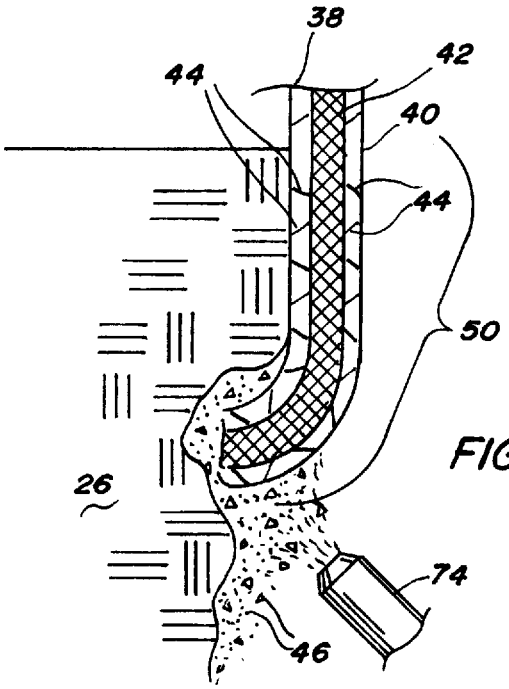

As shown in FIG. 11, strut wires 44 on the inside wire grid of overhang 50 are cut with bolt cutters or the like. This allows a worker to bend overhang 50 such that it makes contact with that portion of pillar 26 near second passageway 22. Wires (not shown) may be installed for tying overhang 50 against the pillar.

After the infrastructure of overcast 28 has been constructed, a plurality of jacks 70, shown in FIG. 1 for example arranged in four rows, are installed under deck 52. A U-shaped channel member 72 connects the jacks in each row, with the web of the channel member pressed against the bottom of deck 52 to spread the load. The inside of sidewalls 48 and the underside of deck 52 are coated with layer of concrete 46 applied as gunite or shotcrete covering grids 38, 40, approximately 1½ inches thick, starting at the base of the panels and working upwards. The concrete applied as gunite or shotcrete is preferably formed with mortar mix and rich in cement, dry mixed at a nozzle 74 with just enough water to form a mixture that when sprayed will stay in place.

As shown in FIG. 11, concrete layer 46 is sprayed on and behind overhang 50 sealing sidewalls 48 to pillar 26. Concrete is also sprayed beyond overhang 50, stabilizing pillar 26 and further ensuring the seal between the sidewall and the pillar.

When the concrete on the inside of sidewalls 48 and the underside of deck 52 has cured enough that it will not be readily knocked off if a worker walks on the top of the deck, layer of concrete 46 is applied as gunite or shotcrete on the upper side of deck 52 and an both sides of wing walls 56. As with sidewalls 48, spraying is continued past the ventilation structure along first and second passageways 20, 22, respectively, to form a tight seal such that overcast 28 does not leak air.

After the concrete on the ventilation structure has cured, jacks 70 and U-shaped channel members 72 are removed. The finished overcast forms an air tight seal between first and second airways 30, 32 and will require no foreseeable maintenance.

Barrier 34 shown in FIG. 4 is constructed in the manner described above with respect to sidewalls 48. Panels 36 forming barrier 34 are fitted across third passageway 24 and up to the ceiling blocking air flow through the passageway when the barrier is coated inside and out with a layer of concrete. Ends of barrier overhang pillars 26 along first passageway and are sealed to the pillar with a layer of concrete as described above. A layer of concrete also extends a distance along the ceiling from the junction between the top of the barrier and the ceiling.

It is to be understood that the same basic principles of construction apply when the ventilation structure is an undercast, stopping or regulator. However when the ventilation structure is an undercast, panels 36 forming deck 52 will form the floor of at least part of first airway 30 and the roof of the second airway 32. Moreover, construction of the undercast ventilation structure will require cutting a trench (not shown) in the floor of the mine passageways at the intersection to form the bottom and sidewalls of the second airway which will extend under the first airway. The deck panels are bridged over the trench, with a space being left uncovered at the ends of the trench to admit air into the trench.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A mine ventilation structure for use in an underground mine having a grid of intersecting passageways separated by columns of remaining material, said passageways having sidewalls and a ceiling, said structure comprising a wall formed of a plurality of panels fitted across the passageway and to the ceiling, said panels assembled in side-by-side relationship with wire fasteners, each panel having first and second spaced apart wire grids with an insulation core, said grids interconnected with strut wires passing through the insulation core and forming a truss system, and a layer of concrete applied as gunite or shotcrete to the assembled panels embedding the strut wires and covering the wire grids, said layer of concrete extending beyond the wall along the passageway and the ceiling whereby the structure forms an air seal in the passageway.

2. A mine ventilation structure for usage at an intersection of first and second passageways in an underground mine having a grid of intersecting passageways separated by columns of remaining material, said ventilation structure defining a first airway communicating with said first passageway and a second airway communicating with said second passageway, said ventilation structure comprising a pair of generally parallel, spaced-apart sidewalls forming the sidewalls of said first airway, each of said sidewalls formed of a plurality of panels fitted across the second passageway, said panels assembled in side-by-side relationship with wire fasteners, a deck which is a roof of one of said first and second airways and a floor of the other of said first and second airways, said deck formed of a plurality of panels spanning the full distance between the sidewalls, said panels assembled in side-by-side relationship with wire fasteners, said ventilation structure further comprising a pair of wing walls, if said spaced-apart sidewalls do not reach the ceiling, each said wing walls formed of a plurality of panels spanning the full distance between the deck and the ceiling, said panels assembled in side-by-side relationship with wire fasteners and said wing walls positioned on the deck above the sidewalls, each of the panels in the sidewalls, deck and wing walls having first and second spaced apart wire grids with an insulation core, said grids interconnected with strut wires passing through the insulation core and forming a truss system, and a layer of concrete applied as gunite or shotcrete to the assembled panels embedding the strut wires and covering the wire grids, said layer of concrete extending beyond the ventilation structure along the first and second passageways and to the ceiling whereby the ventilation structure forms an air seal between the first and second airways.

3. The structure of claim 1 wherein reinforcing members are set vertically in a floor of the passageway and wherein the grids in the panels are spaced from the insulation core, selected ones of said panels set over the reinforcing members with the reinforcing members projecting inside of the grids to permit the grids and the reinforcing members to be embedded in the layer of concrete thereby developing the tensile strength of the grids and the reinforcing members in the panels.

4. The structure of claim 3 wherein the insulation core in the panels is polystyrene.

5. The structure of claim 4 wherein the panels adjacent the ceiling are contoured to the ceiling of the passageway.

6. The structure of claim 5 wherein there is a seam between side-by-side panels, said seam being reinforced on both sides of the panels with a strip of mesh having a mesh pattern which is the same as a mesh pattern of the grids, said strips attached to the grids with connectors.

7. The structure of claim 2 wherein reinforcing members are set vertically in a floor of the first passageway and wherein the grids in the panels are spaced from the insulation core, selected ones of the panels in the sidewalls set over the reinforcing members with the reinforcing members projecting inside of the grids to permit the grids and the reinforcing members to be embedded in the layer of concrete.

8. The structure of claim 7 wherein a plurality of spaced apart, reinforcing bars run parallel with a long axis of each panel in the deck, said bars projecting to the inside of the grid on a lower side of the panel.

9. The structure of claim 8 wherein the insulation core in the panels is polystyrene.

10. The structure of claim 9 wherein there is a wing wall and wherein reinforcing members are set vertically in the ceiling of the first passageway and selected ones of the panels in the wing wall are set over the reinforcing members with the reinforcing members projecting inside of the grids to permit the grids and the reinforcing members to be embedded in the layer of concrete.

11. The structure of claim 10 wherein there is a seam between side-by-side panels, said seam being reinforced on both sides of the panels with a strip of mesh having a mesh pattern which is the same as a mesh pattern of the grids, said strips attached to the grids with connectors.

12. The structure of claim 11 wherein a strip of mesh having a mesh pattern which is the same as a mesh pattern of the grids and preformed with a 90 degree bend is installed where the deck, sidewalls and wing wall meet at inside and outside corners.

* * * * *

UNITED STATES PATENT AND TRADEMARK OFFICE

CERTIFICATE OF CORRECTION

PATENT NO. : 5,879,231
APPLICATION NO. : 08/976025
DATED : March 9, 1999
INVENTOR(S) : Frank A. Sisk It is certified that error appears in the above-identified patent and that said Letters Patent is hereby corrected as shown below:

In the specification:
In column 1, line 2, before "BACKGROUND OF THE INVENTION" add:
This application claims priority from provisional application serial No. 60/031,635, filed November 22, 1996, for Ventilation Control System Formed From Shotcreted Spaced Sheets Of Wire Mesh.

Signed and Sealed this
Sixth Day of September, 2011

David J. Kappos

David J. Kappos
*Director of the United States Patent and Trademark Office*